United States Patent [19]

Sarid

[11] 3,962,816

[45] June 15, 1976

[54] FOLDABLE STRUCTURE

[76] Inventor: Iris Sarid, 27 Tiberias Str., Jerusalem, Israel

[22] Filed: Nov. 26, 1974

[21] Appl. No.: 527,278

[52] U.S. Cl. ..... 46/1 R; 46/1 L
[51] Int. Cl.[2] ..... A63H 33/16
[58] Field of Search ..... 46/1 L, 35, 36; 273/155

[56] References Cited

UNITED STATES PATENTS

| | | | |
|---|---|---|---|
| 2,633,657 | 4/1953 | Warren | 46/1 L |
| 2,922,239 | 1/1960 | Glynn | 46/1 L |
| 3,730,818 | 5/1973 | Salinari | 46/1 L |

*Primary Examiner*—Louis G. Mancene
*Assistant Examiner*—Robert F. Cutting
*Attorney, Agent, or Firm*—Browdy and Neimark

[57] ABSTRACT

A foldable structure consisting of a substantially, rectangular continuous strip comprising at least twelve squares flexibly hinged together and arranged in parallel rows and columns with reference to the top and bottom edges of said strip wherein each of said squares is bisected by a diagonal and the two triangular halves of each of said squares are adapted for spatial displacement with relation to each other along said diagonal.

2 Claims, 4 Drawing Figures

FOLDABLE STRUCTURE

BACKGROUND OF THE INVENTION

1. Field of the Invention

The present invention relates to foldable structures. More particularly the present invention relates to a structure adapted for manipulation to present a plurality of changeable panels and structures to the user. The article is manipulatable by spatial displacement along a plurality of axes provided in said structure. The structure of the present invention is suitable as an amusement device with varied colored sections of opaque or transparent material adapted for overlapping or kaleidoscope type of display or as a geometrical, educational or constructional device. It can also be utilized for advertising and display purposes.

2. Description of the Prior Art

Foldable structures having similar although more limited uses are known in the prior art. Thus for example U.S. Pat. No. 3,302,321 teaches a creased blank of paper cardboard, or similar foldable material having a plurality of equally spaced hinge means parallel to the bottom edge of said blank, a second set of equally spaced hinge means angularly related to said first set and a third set of equally spaced hinge means substantially transverse of said second set. Similarly, U.S. Pat. No. 1,997,022 teaches an advertising medium or toy comprising a plurality of tetrahedron bodies flexible hinged together in an endless series around a common center with the hinges at opposite ends of each body extending at an angle to each other and all the bodies being simultaneously rotatable about their respective axes. Both of said patents however, have only a relatively limited number of possible positions by virtue of their construction and adaptation for rotation primarily around a central axis.

SUMMARY OF THE INVENTION

According to the present invention there is now provided a foldable structure having much greater flexibility than prior art structures and adapted by virtue of its construction for displacement along a plurality of axes as well as rotation around its central axis. Thus the present invention provides a foldable structure consisting of a substantially, rectangular continuous strip comprising at least twelve squares flexibly hinged together and arranged in parallel rows and columns with reference to the top and bottom edges of said strip wherein each of said squares is bisected by a diagonal and the two triangular halves of each of said squares are adapted for spatial displacement with relation to each other along said diagonal.

In U.S. Pat. No. 2,007,421 there is described a puzzle formed from a square blank having diagonal crease lines, however said patent is directed to the method of producing said puzzle from said blank and does not teach or suggest a foldable structure consisting of a substantially continuous strip adapted to assume a multiplicity of two and three dimensional forms by means of displacement and rotation along a plurality of axes, including a central axis.

While the invention will now be described in connection with certain preferred embodiments in the following illustrative Figures it will be understood that it is not intended to limit the invention to these particular embodiments. On the contrary it is intended to cover all alternatives, modifications and equivalents as may be included within the scope of the invention as defined by the appended claims.

BRIEF DESCRIPTION OF THE DRAWINGS

In order that the invention may be understood more fully, reference should be had to the following illustrative description read in conjunction with the accompanying drawings in which.

With specific reference now to the figures in detail it is stressed that the particulars shown are by way of example and for purposes of illustrative discussion of a preferred embodiment of the present invention only and are presented in the cause of providing what is believed to be the most useful and readily understood description of the principles and conceptual aspects of the invention. In this regard no attempt is made to show structural details of the system in more detail than is necessary for a fundamental undetstanding of the invention, the description taken with the drawings making apparent to those skilled in the art how the several forms of the invention may be embodied in practice.

Figure 1:
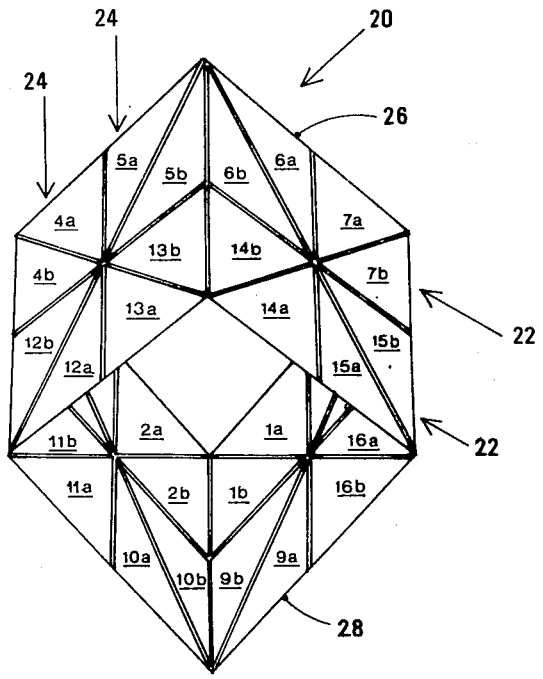
FIG. 1 shows a perspective view of a foldable structure according to the invention.

Referring first to FIG. 1 there is shown a top frontal perspective view of a foldable structure 20 according to the present invention consisting of a substantially rectangular continuous strip comprising a plurality of squares 1–16 (some not shown or shown only in part) flexibly hinged together and arranged in parallel rows 22 and columns 24 with reference to the top 26 and bottom 28 edges of said strip. Each of said squares 1–16 is bisected by a diagonal and the two triangular halves a and b of each of said squares is adapted for spatial displacement with relation to each other along said diagonal.

As illustrated in said preferred embodiment each of said squares is bisected by a diagonal hinge which forms a right angle with each of the diagonal hinges of its three adjacent squares. It has been found that such an arrangement gives maximum flexibility in the structure described and is preferred, however in structures having more squares and thus arranged with more rows and/or columns, squares bisected by a diagonal hinge forming a right angle with the diagonal hinge of at least two adjacent squares also result in the formation of foldable structures having much greater manipulatibility and possibilities of configuration than prior art structures.

Figure 2:
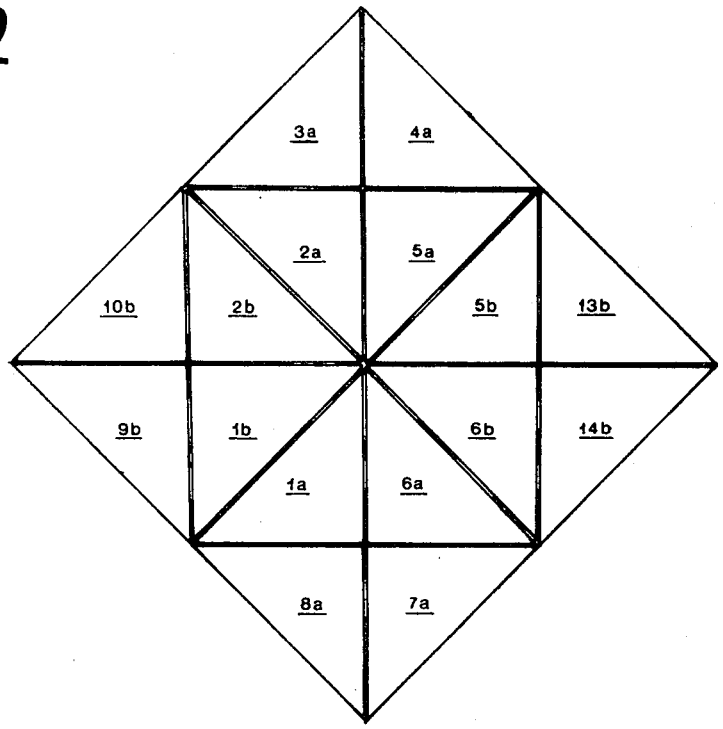
FIG. 2 shows a plan view of the foldable structure of FIG. 1 in one of its myriad possible configurations.
Figure 3:
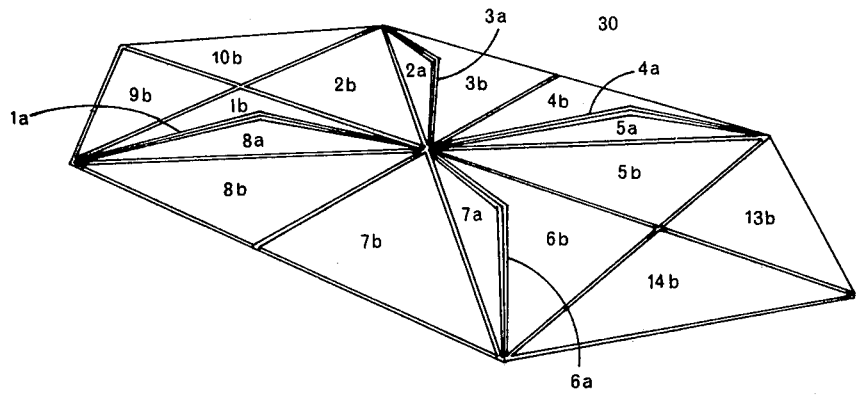
FIGS. 3 & 4 show perspective views of the foldable structure of FIGS. 1 and 2 having undergone further folding.
Figure 4:
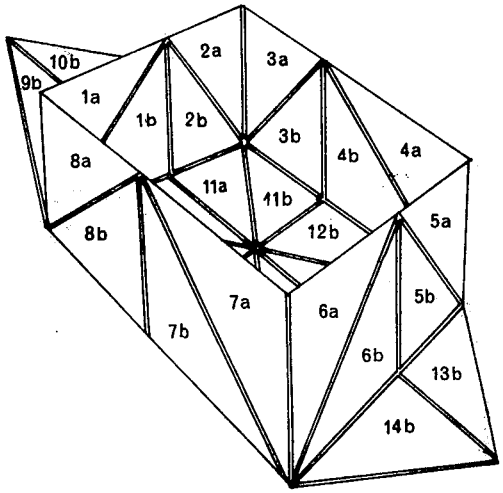

Referring again to the Figures, if the structure shown in FIG. 1 is folded along the diagonal hinges between triangles 9*a* and 9*b;* 8*a* and 8*b* (not shown); 10*a* and 10*b;* 3*a* and 3*b* (not shown); 4*a* and 4*b;* 13*a* and 13*b;* 14*a* and 14*b;* and 7*a* and 7*b* there is formed the flat structure illustrated. in FIG. 2. If for example said flat structure of FIG. 2 is then folded along the hinges common to triangles 3*a* and 2*a;* 4*a* and 5*a;* 1*a* and 8*a;* and 6*a* and 7*a* there is formed the three dimensional structure shown in FIG. 3. An upward and outward pull at juncture point 30 will then, in turn, transform the structure of FIG. 3 into the structure shown in FIG. 4.

While not illustrated, it will be realized by those skilled in the art that there are hundreds of possible configurations and even free standing three-dimensional structures which can be produced even with the 16 squared structure illustrated, and that the addition of further squares in accordance with the principles described herein results in the multiplication of the number of such possibilities. While in its simplest form said structure could be made from cardboard sections foldably hinged together with tape, more sophisticated hinged, foldable structures could use rigid and flexible plastic, and/or other materials which will readily suggest themselves.

It will be evident to those skilled in the art that the invention is not limited to the details of the foregoing illustrative embodiments and that the present invention may be embodied in other specific forms without departing from the spirit or essential attributes thereof. It is therefore desired that the present embodiments be considered in all respects as illustrative and not restrictive, reference being made to the appended claims, rather than to the foregoing description, in which it is intended to claim all modifications coming within the scope and spirit of the invention.

What is claimed is:

1. A closed, foldable blank for forming two and three dimensional structures, comprising at least three large square faces, each face being connected to two adjacent faces by transverse fold lines, and each face having a third transverse fold line bisecting said face, a further fold line perpendicular to said transverse fold lines at the midpoints thereof, thereby dividing each face into four small squares, and two diagonal fold lines connecting the corners of each face thereby dividing each small square into two triangles.

2. A closed, foldable blank according to claim 1 wherein said blank has four large square faces.

* * * * *